US005893790A

United States Patent [19]

Montgomery

[11] Patent Number: 5,893,790

[45] Date of Patent: Apr. 13, 1999

[54] AERODYNAMIC, HELIUM FILLED, PERIMETER WEIGHTED, NEUTRAL BUOYANT, MYLAR TOY

[76] Inventor: Jeffrey Lewis Montgomery, 17019 67th Ave. NE., Arlington, Wash. 98223

[21] Appl. No.: 09/003,074

[22] Filed: Jan. 5, 1998

[51] Int. Cl.[6] ..... A63H 3/06

[52] U.S. Cl. ..... 446/220; 446/225

[58] Field of Search ..... 446/220, 224, 446/225; 244/31

[56] References Cited

U.S. PATENT DOCUMENTS

| | | | |
|---|---|---|---|
| 1,858,460 | 5/1932 | Ranseen | 446/225 |
| 3,225,488 | 12/1965 | Goldfarb | 446/225 |
| 3,591,975 | 7/1971 | Terc | 46/87 |
| 4,307,537 | 12/1981 | Bergman | 46/87 |
| 4,547,167 | 10/1985 | Bergman | 446/220 |
| 5,045,011 | 9/1991 | Lovik | 446/46 |
| 5,088,952 | 2/1992 | Goldblatt | 446/220 |
| 5,123,869 | 6/1992 | Schippmann | 446/46 |
| 5,765,831 | 6/1998 | Huffhines | 273/348.4 |

*Primary Examiner*—Robert A. Hafer
*Assistant Examiner*—Laura Fossum

[57] ABSTRACT

An aerodynamic, neutrally bouyant, mylar toy, comprises itself of a helium filled, mylar brand balloon with its accompaning convenient, flexible one-way valve, which is specifically weighted at its perimeter to exhibit dynamic flight characteristics due primarily to its centrifugal properties.The aerodynamic toy is weighted with a variety of ballasts to achieve a horizontal, neutral buoyant, list-free, static equilibrium attitude. Such ballasts are ingeniously positioned to first offset the intrinsic weight of said fill valve to create a list-free horizontal attitude. Ballast is subsequently added to the perimeter until said toy is counterballanced against the forces of gravity. In the case of a round balloon weighted and positioned horizontally, some ballast is added at its southern most concentric axis in order to easily facilitate the return of a neutral buoyant attitude of said toy, due to the inevitable loss of helium,and without effecting its said static, list-free equilibrium. Means are described to concisely and creatively weight several aerodynamically shaped balloons and it is the specific placement at their perimeters that dramatically enhances the flight, spin and stability of any or all helium filled, neutrally balanced, mylar toys.

3 Claims, 4 Drawing Sheets

AERODYNAMIC, HELIUM FILLED, PERIMETER WEIGHTED, NEUTRAL BUOYANT, MYLAR TOY

BACKGROUND

1. Field of Invention

This invention relates to an aerodynamic, helium filled, free floating, perimeter weighted, neutral buoyant Mylar® toy, educational device or advertising vehicle, which is constructed to have a fixed static equilibrium and be used as an indoor toy, device, etc., and specifically to its enhanced shapes, designs, means of ballast, and balancing characteristics.

2. Description of Prior Art

The design for this invention has been optimized to it's fullest to take advantage of present day Mylar® balloon technology with its visually attractive, educational and amusing qualities.

Mankind is a very spatial creature and based on our most popular sports, the flight of an object is a captivating event. Therefore, it has been my intention for years to create a toy with tremendous playability, visibility and hang time. This invention relates to a toy but will also function as a highly visible advertising and marketing tool.

With the coming of the new millenium, and the ever-increasing demands that societies place on quality entertainment requirements, it has been my desire to fill the needs for simple indoor fun in the next century. Unlike the contention in the background of the U.S. Pat. No. 5,038,952 to Goldblatt (1992) that airborne free-floating hovering toys of the nature are "well known and commercially available", it is my belief that this is anything but factual and that indeed the opposite is true. In years of comprehensive research I have been unable to locate any neutral buoyancy products and, in turn, believe this to be a wide open market provided that the finest aspects are incorporated in the final product.

In the U.S. Pat. No. 4,307,537 to Bergmann (1981) it contends that ballast at the lower portion of the toy to balance the toy and secure an upright position when it is free floating is effective, however, this alone will not enhance it's play-ability, flight and spin-ability; the exposed seams and lack of perimeter weighting considerably inhibits the flight and spin capabilities. Barometric pressure is also cited as contributing factors to neutral buoyancy, whereas temperature and humidity, which were not cited, exert a far more profound effect upon the toy. The colder the ambient temperature of the air the more ballast is required to offset the buoyancy. Furthermore temperature gradient will condense water in the air, and increased relative humidity will exacerbate condensation internally and on the surface of the toy, causing further disturbance of the balanced state, and can effect the propensity for the toy to be refilled with helium. His patent goes on to state that his invention can be used outside and which, regardless of wind currents and violent throwing of the toy, it will eventually return to a predetermined altitude. It is my contention that this would not be the case, unless the toy is over-weighted beyond a neutral buoyant attitude and great diligence was applied to be aware of the toy's ability to fly away. The use of this toy is as an indoor toy and any claim to the contrary is irresponsible. Mylar® by its nature is not a biodegradable product and it has a potent reflective quality making it a nuisance to radar and navigational equipment. Every Mylar® balloon sold today is imprinted with a warning regarding release outdoors. Bergman, 4 years later applied for and received an additional U.S. Pat. No. 4,547,167 (1985) to further his monopoly on pressure sensitive fasteners and their specific locations for maintaining altitude and attitude. It still did not encompass what I believe to be the necessary and critical configurations for an optimally functional, neutral buoyant toy. In the U.S. Pat. No. 5,123,869 to Schipmann (1992) it demonstrates an aerodynamic toy consisting of a flexible web material with a web of annular configuration, etc., that if oriented and positioned with a helium filled balloon, will effect the flight. It is my contention that in order for his invention to have even the slightest degree of buoyancy, the toy would have to be of immense size and/or constructed of such a light-weight material, that it would prove to be either too costly to produce for the average public or the material might not yet exist. Shipmann's toy is viably buoyant with a hydrogen filled bladder, but it would be difficult to classify it as a toy at that point In the U.S. Pat. No. 3,591,975 to Terc 1971 discloses some specifics of counter-balancing to achieve a neutral buoyant state, but that appears to be the only correlating factor.

OBJECTS AND ADVANTAGES

Accordingly, besides the objects and advantages of the neutral buoyant Mylar® toy described in my above patent, several more objects and advantages are;

1. to provide quality entertainment for all ages;

(a) novel in its effects;

(b) captivating in its appearance;

(c) spatially enhancing: one of mankind's natural tendencies;

(d) imaginative aspects, ie: inspires fantasies of space life and travel;

(e) inter-active play for one or more: offering games from a form of couch potato catch to versions of golf and unlike other ball games, one need not bend over to pick up toy ball after each missed toss/catch;

(f) provides variety of gift giving options and occasions;

(g) provides safe indoor fun;

(h) inexpensive to own and extremely inexpensive to operate, ie: no batteries required;

(i) therapeutical aspects and potentials, ie: Geriatrics, pre-schools, day-cares etc.

(j) educational aspects and potentials even more vast and promising;

2. To provide for advertising and marketing needs;

(k) surface of toy provides ample advertising space for corporate logos, slogans, etc.;

(L) since toy is novel, captivating, visually and spatially enhancing, consumers eye is drawn to toy and therefore to advertisement;

(m) the sales of advertising space as to size, local, per quantity, toy, etc., offers an in creased revenue source, thus enhancing and even insuring the success of this patent;

(N) advertisement provided made affordable or optionally exclusive, allowing for a number of optional licensing agreements of the nature that this patent is designed to protect.

3. Provisions for manufacturing and distributing;

(o) provides a cost effective product with sufficient profit over costs margin;

(p) provides an ease of construction factor requiring minimal technical skills;

(q) provides a large variety of styles, colors, designs, etc.;

(r) provides an ease of shipping and handling; toys can be pre-inflated and neutrally weighted prior to ground or air shipping.(some deflation has occurred in air shipments over the Rocky mountain range, but product does have re-filling capabilities);

(s) manufacturing and distribution is easily facilitated on site, ie: stores, malls, kiosks, etc.;

(t) provides franchising capabilities and licensing agreements of the nature that this patent is designed to protect.

BRIEF DESCRIPTION IN DRAWINGS

Figure 1:
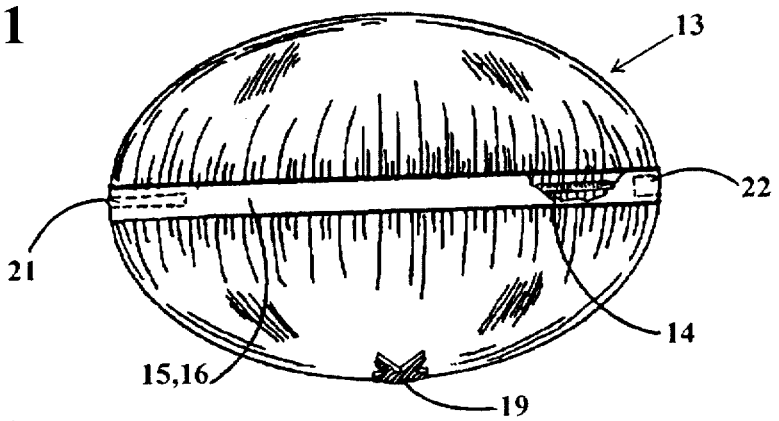
FIG. 1 is an elevated side view of an aerodynamic neutral buoyant helium filled Mylar® toy entailing perimeter and concentric weights.
Figure 2:
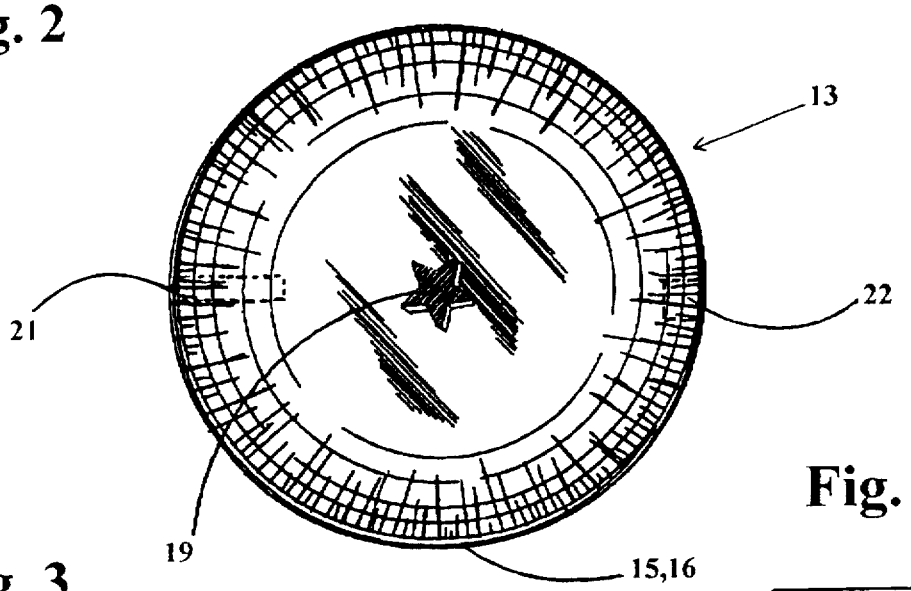
FIG. 2 is the underside of FIG. 1 depicting concentric weight(s) in order to maintain static flight, neutral buoyancy, and ease re-balancing of round toys and drawing also depicts the subtle layers of adhesive perimeter weighting.
Figure 2A:
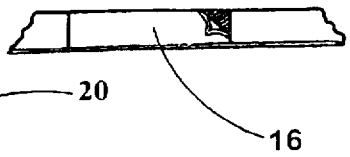
Figure 3:
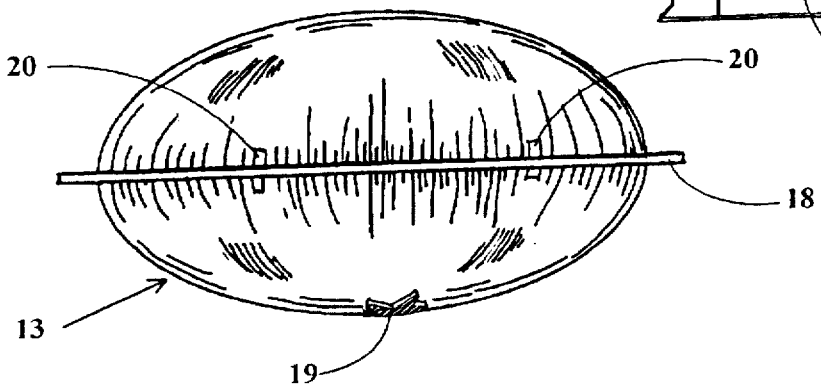
Figure 4:
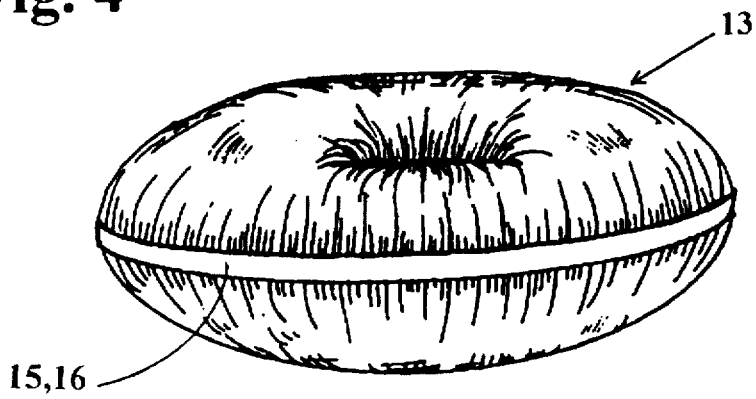
Figure 5:
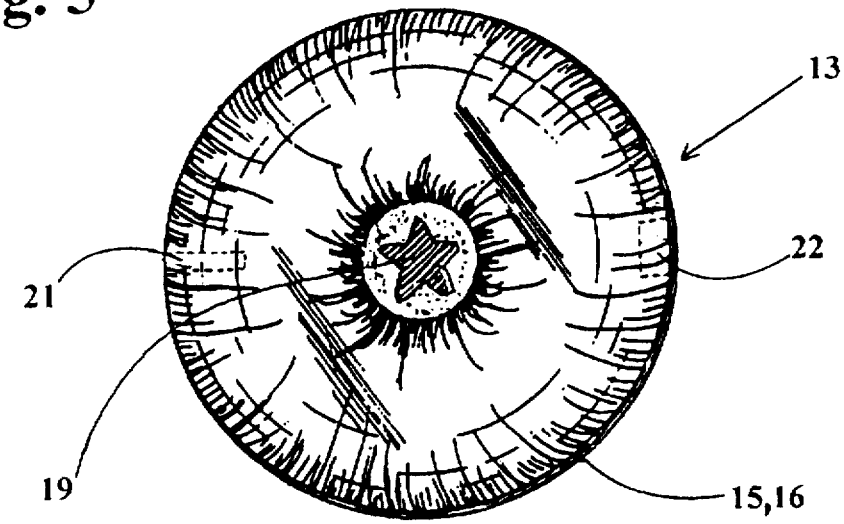
Figure 6:
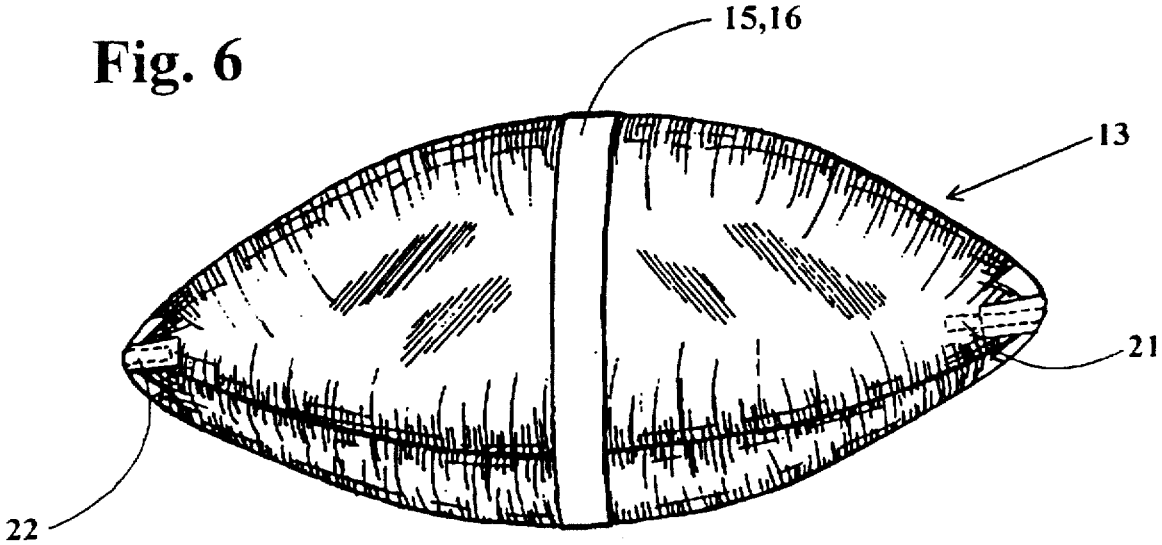
Figure 7:
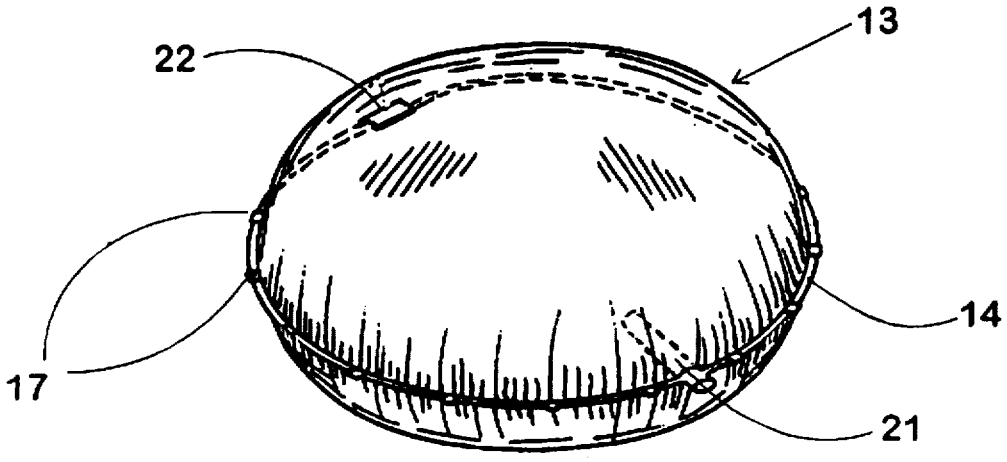
Figure 8:
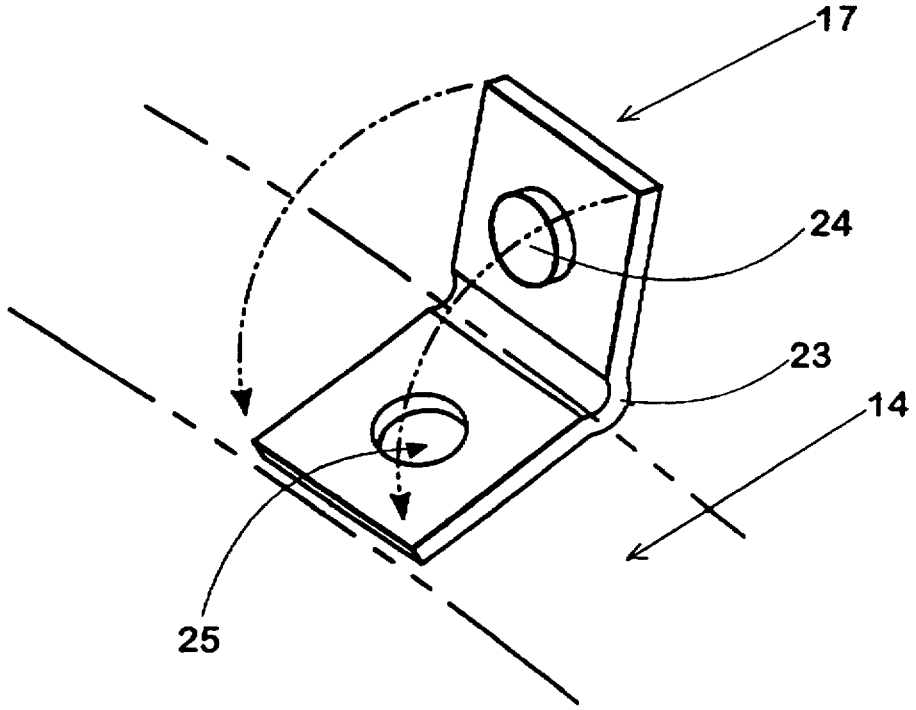
Figure 9:
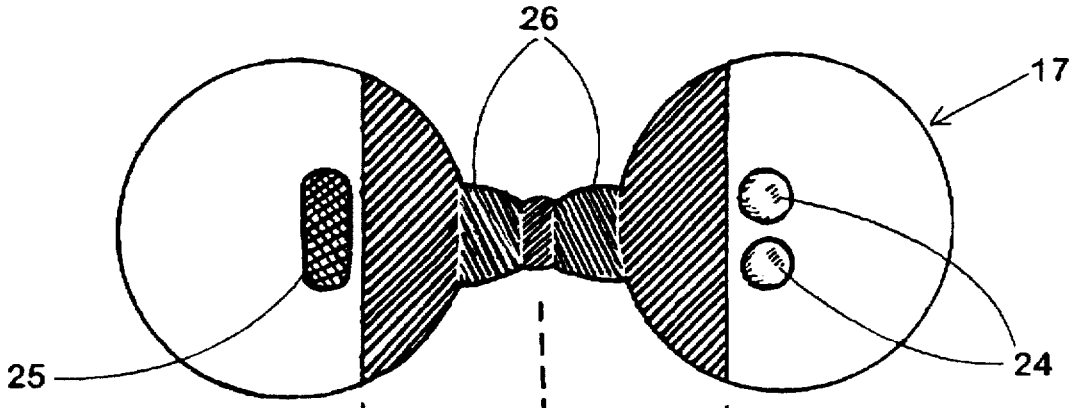
Figure 10:
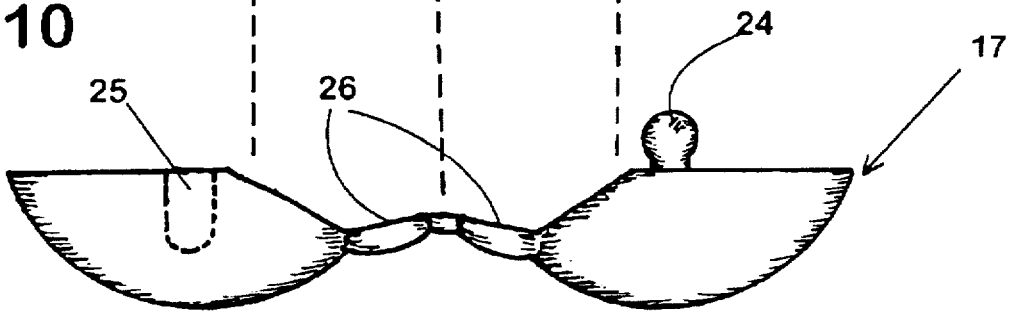
Figure 11:
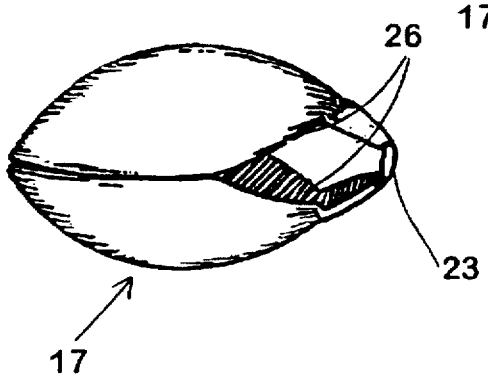

FIG. 2*a* is an example of laminated, pre-sectioned adhesives for perimeter weighting;

FIG. 3 is an elevated side view of said same toy with perimeter weight consisting of a light weight die-cut material and affixed with adhesive tabs to said toy at its perimeter seam;

FIG. 4 is a similar toy with its two concentric axis sealed together;

FIG. 5 is an underside view of FIG. 4;

FIG. 6 is an elevated side view of a multiple paneled, marquis-cut Mylar® football with adhesive ballas at its nose tail and perimeter positions;

FIG. 7 is a perspective view of a said round toy with perimeter ballast consisting of plastic clips;

FIGS. 8–12 are designs depicting ballast clips;

BRIEF SUMMARY OF THE INVENTION

Toys or educational objects of these types of inventions comprise themselves of a lighter than air, gas filled, aluminum coated polyethylene terephthalate panels that are heat sealed to the desired shapes as to be described in the accompanying description and embodiments to be referred to hereinafter as Mylar®, are to be weighted at their perimeter and concentric locations respectfully so as to achieve a weightless list-free static attitude until otherwise set in motion by manual manipulation. Whether it is adhesives, plastic clips, or die-cut paper or foams it is it's concise positioning that this patent application is designed to protect.

DESCRIPTION—MAIN EMBODIMENTS

In the first form of the invention of the round shaped Mylar® toy13, helium is added to inflate it in a taught manner. Specific opposing weight22 of approximately 6/10ths of a gram is added to counter valve weight21 and create a list-free property to said toy13, then the toy13 is weighted with polyester adhesives15, uniformly but not exclusively, around its outer seam14 in order to cover said seam14, increase it's attractiveness, and mainly to enable it's aerodynamic and centrifugal properties to apply. In regards to a fifteen to eighteen inch balloon13 approximately 2½–3 grams of adhesives15,16, clips17 or die-cut material18 is added in addition to said valve counter-weight22 to further static and neutrally balance said toy13, however toy13 should still have positive buoyant attitude so as to allow for additional adhesive ballast19 to be added to the bottom concentric axis19 in a stacked or concise fashion until a zero gravity effect or neutral buoyancy is achieved. Concentric weighting19 allows user to easily adjust buoyancy in regards to the short-term life of said toy13, however in order to extend the said toy's13 use over a longer period, the removal of perimeter weights15,17,18 can be accomplished with ease but it must be remembered to be removed in sections directly opposite itself as-to retain it's static list-free operation. In the instance where a larger balloon13 is to be utilized and subsequently a larger volume of helium, the ratio of said ballast required, increases exponentially.

In the second form of the invention where the center axis points of the Mylar® panels13 are sealed, the balloon13 must be larger than 18 inches in order to contain sufficient gas to allow lift with properly positioned weights or ballast15–19 in order to retain it's said aerodynamic capabilities.

In the third form in respect to the football shaped Mylar® toy13, 3 or 4 marquis cut panels are sealed and its accompanying patented valve21, inserted at it's nose or tail as the case may be; is folded and sealed. Said valve21 is then counter-weighted22 as to achieve said static list-free attitude. Hereinafter said toy13 can be weighted with polyester adhesives15 around its most perimeter point until neutral buoyancy is achieved. Heretofore when said toys are manually flung softly with a spinning motion applied at the same time said toy13 travels an impressive distance without losing elevation and only changing direction slightly in a drawn fashion in accordance with the direction of said spin.

In the fourth form of the invention in respect to ballast members15–20 that can be obtained and assembled separately from the said toy13, weights15–20 are added to the said perimeter seam14 and concentric axis, respectfully; by the technician or the consumer to any said round balloon13 in order to achieve said desired results.

DESCRIPTION OF PREFERED EMBODIMENTS

As seen in FIGS. 1,2,3,4,5,6,7, a neutral buoyancy toy13 of the first form of the invention consists of a gas filled envelope13 which is made of polyethylene terephthalate panels13, and presently sold under the Dupont trademark of Mylar®, is coated with a metallic film such as aluminum having the properties of a light in weight, un-stretchable, and substantially impermeable to gases such as helium; and in conjunction with its accompanying patented one way filling valve21, will be hereinafter referred to as a Mylar® balloon13, toy13, product13, or invention13. The said Mylar® invention13, with it's patented valve21, is inflated with helium and it's protruding valve21 is either folded in for future refilling, if product is viable, or said valve21, is cut short and taped accordingly. The perimeter seam14 of round balloons13 in FIGS. 1–5&7, will fold upwards or downwards when said balloon13 is filled to its maximum dimension. It is then ideally but not exclusively necessary that the off centered seam14 is folded up or down or to one side or the other, in order to assist the toy13 in having a more controlled static position of up and down. At this point an opposing weight22 of approximately 6/10ths of a gram is added to the adjacent side of said valve21 to further aid in a stable, static, list-free attitude. The perimeter can now be weighted with any desired various adhesives15 such as Mylar® brand, 3M or other polyester tapes, vinyl, masking15, etc Application of said adhesives15 around the perimeter seam14 annularly, seals the unfinished appearance of the seam14 and can be offset below said seam14 to further enhance its upright static attitude. Perimeter weight15 is approximately 3–4 grams of weight for 15 to 18 inch balloons, and is increased in weight exponentially as balloon's13 size increases. Appropriately sufficient ballast15 around perimeter14 should be added so as said balloon13 still has slight positive buoyancy with a list-free attitude allowing for additional adhesive ballast19, or pressure sensitive laminated modules19, to be applied at the bottom or southern concentric axis of the toy13 until neutral buoyancy is achieved. It will prove true that within the first 24 to 48 hrs that said toy13 will increase in buoyancy and will require more ballast15 either at concentric19 or perimeter14 locals, at manufacturer or consumer's discretion, to retain it's neutral equilibrium. This mild phenomenon is based on the inherent dissipation of helium from said toy13 and the fact that heavily condensed helium is actually heavier than that which is less in it's compression respectfully. This natural factor will be used in the manufacturing end as an advantage allowing products13 through shipping and/or handling sufficient time to stabilize prior to the sale and receipt of said product13. It is also relevant at this time to disclose that rough play such as the forceful striking of said toy13 does tend to accelerate the loss and dissipation of said gas. When said toy13 is constructed in said manner it is static balanced to have one side consistently constituted as the bottom portion thereof; and ballast at said bottom portion are not exclusively the cause of its static upright positioning but its minor weight addition does enhance and accelerate its return to said static position when said toy13 is free of manual manipulation and other external forces. Annularly positioned weighting15 that is narrow in shape and size tends to increase stability and enhance centrifugal properties over that of a wider band around the perimeter14. It is for this reason that said die-cut18 design holds an advantage in its intrinsic flight capabilities. Because said die-cut ring's18 construction requires it to be thin in design to reduce it's weight, the absolute perimeter of said ring18 is further out and away from the perimeter seam14 of said toy, noticeably enhancing said centrifugal properties.

In each form of the invention13 shown herein, the majority of said neutral buoyant ballast15 is at toys13 most perimeter14, and heretofore; conveniently seals the seam14 for aerodynamic and cosmetic enhancements, excepting in the case of FIG. 6 illustrating the tri or quad-shaped paneled football which has 2–3 seams sealed and folded internally, subsequently requiring only one seam, at the most, to be sealed down with a Mylar® or polyester adhesive prior to its perimeter weights being added. Means are provided for balancing instant inventions with respects to each individual shapes as necessary. Perimeter weighting15 need not be exclusively of a one-sided adhesive15 but can be in addition of a two-sided adhesive16 with scored sections of pressure sensitive fasteners16 allowing for removal of correspondingly adjacent sections so as to maintain its desired static list-free balanced altitude and attitude.

Ballast modules at the southern concentric axis19 are ideally but not exclusively of a pressure sensitive adhesive that does not leave its adhesive residue behind upon removal and can be re-applied a reasonable number of times with out much contamination or failure. Many products exist, and I have surmised that vinyl adhesives such as contact and/or shelf paper can be laminated with alternatively tackier, heavier, and cosmetically enhanced adhesives allowing for optimal convenience of said modules.

In FIG. 3 said balloons will be weighted with a lightweight die-cut material18 of cardboard18 or laminated foam board18 to allow user/consumer an ease of application and said product to be available to said consumer separately from said balloon13, subsequently offering a range of sizes designs and options pertaining to its use and re-use. Outer die-cut discs18 are optimally used in conjunction with concentric ballasts19 and said die-cut disc18 will be offered with sufficient directions as to their individual applications for a successful toy13 in regards to the means of the claims in this invention.

In FIGS. 4 and 5 the Mylar® balloons'13 concentric axis point is sealed together allowing for an exact location of concentric ballast members19 at the underside portion of said balloon and an optional variety of look and feel. After the application of perimeter weighting15–18 in conjunction with concentric weights19, toy will exhibit a slightly higher degree of centrifugal properties as well as a unique and novel appearance. Said toy13 requires a size increase of that greater than 18 inches in diameter to ensure that substantial helium is encased so as to guarantee substantial buoyancy and require an appropriate amount of ballast encompassing all the aspects and qualities of a successful toy13 heretofore described. Perimeter weighting15–18 still encompasses and applies to the heretofore claims of adhesives15, adhesive fasteners or laminated modules16, die-cut materials18, and plastic clip-on ballast17.

In FIG. 6 a Mylar® balloon13 in the shape of a football will be made up of 3 or 4 marquis cut or pointed oval shaped panels13 with as many seams as possible sealed and internalized into said ball so as to maintain the highest degree of aerodynamics as possible. If ideal construction of said Mylar® football leaves one seam exposed, seam is easily concealed with a polyester tape offering enhanced cosmetics and minimal weight interference. After inflation with helium through the flexible self-sealing internal valve21 that is positioned at one end of said ball, is subsequently folded and sealed with polyester tape of the same metallic shade as said toy13. Sufficient ballast of the adhesive type is then added to the adjacent tail end to affix opposing valve weight22, in order to create a static list-free attitude of said ball. Metallic polyester adhesives15 of like, opposing or dissimilar shades are added at said balls most perimeter or fat side until a neutral buoyant static equilibrium or a zero gravitational effect is established. Football can now be manually manipulated with one or both hands in a forward spiral motion, subsequently exhibiting a dramatic flight as if connected to a frozen rope. A slight increase in size is required over that of a standard regulation ball, in order to allow enough helium and subsequent buoyancy to require substantial addition of required said ballast15,22 to achieve said toys optimal effects.

Figure 12:
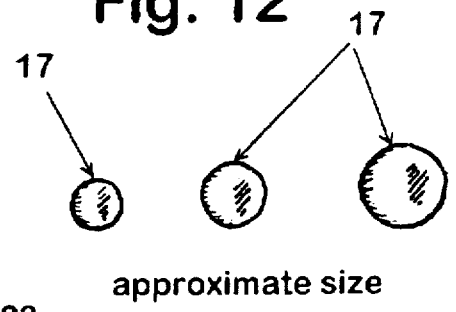

In FIGS. 7–12 means are shown herein to form the claim of further ballast modules17 that are optionally applied to the perimeter14 of all round balloons in order to offer the general public a product that may be obtained separately or in kit form and allowing user/consumer freedom of varying applications of said ballast17. Said ballast clips17 are usually, but not exclusively, of an aerated molded plastic, designed with press-fit male24, female fittings25, in order to grasp said perimeter seam14 and not be forced off during rough or forceful striking of said toy13. Said clips17 are ideally designed in FIGS. 9–11 to sustain an ample grip on said perimeter seam14 and offer a quick release design26 in order to facilitate re-weighting to a neutral buoyant, static equilibrium state. After the introduction of helium into or subsequent purchase of said pre-inflated balloon13, the protruding valve stem21 is optionally cut and summarily folded, and sealed either with polyester adhesives15 or ballast clips17. An appropriately weighted ballast clip or clips17 are added to the adjacent side of said valve21 and a list-free attitude is obtained. Clips17 are subsequently attached to the perimeter seam14 of said balloons13 until a static list-free neutral buoyant attitude is almost achieved, at this point additional concentric19 adhesive ballast, hereunto provided with all kits; is added to the bottom portion at their most concentric location until the zero gravity effect is achieved. In the embodiments shown in FIGS. 8–12, detachable clips17 are provided with various functioning abilities, shapes, and sizes as illustrated in FIG. 12. Individual weights, colors, and costs are furthermore some additionally available options. Ballast clips17 and concentric adhesives modules19 can be removed as stated in previous portions of this claim, as buoyancy of said toys13 gradually decreases over time, due to the inevitable escape of said helium.

REFERENCE NUMERALS IN DRAWINGS

13 Mylar® toy, balloon, envelope, invention, or polyethylene terephthalate panels

14 perimeter, perimeter seam, or sealed flange

15 perimeter weight(s)/ballast, or perimeter adhesives/polyester, vinyl, masking, etc.

16 laminated perimeter weight(s)/ballast, or pre-sectioned laminated modules

17 perimeter ballast clips

18 perimeter die-cut ballast/material/ring, or circular die-cut ballast/material/ring

19 concentric weight(s)/ballast, laminated concentric weight(s)/ballast, or concentric weight(s)/ballast/modules (all adhesive in their scope and nature)

20 adhesive tabs to secure die-cut ring

21 flexible one-way filling valve (patented or patent pending)

22 opposing valve weight/ballast

Ballast clips specific embodiments:

23 living hinge

24 press-fittings—male

25 press-fittings—female

26 quick-press release

SUMMARY, RAMIFICATIONS, AND SCOPE

Accordingly, the reader will see that with the present invention, an appropriately shaped Mylar® balloon or polyethylene terephthalate paneled envelope filled with helium, is predominately weighted at its most perimeter with a variety of adhesives, die-cut materials, and/or plastic ballast clips; the neutral buoyant toy will exhibit optimal centrifugal characteristics and an enhanced flight. This invention contains all the advantages of present day knowledge and ingenuity and it's my goal to use that knowledge to create the next national, if not global trend, to bring the next Frisbee to the public and to help solve the need for more safe and imaginative indoor entertainment. The invention of the Nerf ball, in my estimation; was the last safe, brainless toy to fill that need that this inventor can recall, and I believe that the inventors listed above had a similar desire in mind but have yet to achieve a viable product that could be classified a trend on any significant scale if at any scale at all. Safe neutral buoyant toys will be the future and I believe that not only does this invention fill the requirements of novelty, utilitarian, and non-obvious classifications, but I also intend to add success as another aspect to its patentability. Furthermore the reader need only study and comprehend the objects and advantages cited previously in this patent to fully appreciate the scope and ramifications of this invention. Although the descriptions cited above contain many specifics, these should not be construed as limiting the scope of the invention but as merely providing illustrations of some of the presently preferred embodiments of this invention. For example, there are a number of viable shapes yet to be designed that contain aerodynamic qualities, and an even larger number of ballast designs and configurations that could apply. Thus the scope of this invention should be determined by the intended claim heretofore cited and any or all appended claims and their legal equivalents.

I claim:

1. A centrifugal aerodynamic neutral buoyant toy comprising:

a balloon filled with lighter-than-air gas, said balloon being formed from at least two polyethylene terephthalate panels, said panels being sealed together along their edges to form an envelope having at least one annular seam extending around the entire perimeter;

a plurality of releasably attached ballast members uniformly disposed around the entire perimeter on the seam of the balloon, said plurality of releasably attached ballast members dimensioned and arranged to weight said balloon to a near neutral state;

concentric ballast releasably attached centrally to a bottom one of said panels, said concentric ballast dimensioned and arranged to assist said plurality of ballast members in maintaining said balloon at a desired altitude; and wherein said balloon with said plurality of ballast members and said concentric ballast are dimensioned and arranged to achieve a neutral buoyancy, a horizontal attitude and exhibit dynamic flight characteristics due primarily to its centrifugal properties at a desired attitude and altitude.

2. The neutral buoyant toy of claim 1, wherein said releasably attached ballast members are from the group consisting of: adhesives, pre-sectioned adhesive modules, pre-formed die-cut rings, and plastic ballast clips.

3. A centrifugal aerodynamic neutral buoyant toy comprising:

a balloon filled with lighter-than-air gas, said balloon being formed from at least three polyethylene terephthalate panels, said panels being scaled together along their edges to form a substantially football-shaped oblong ball having a plurality of seams extending from one end of said oblong ball to the other end of said oblong ball;

a plurality of ballast members uniformly and centrally disposed around an entire perimeter of said oblong ball at a distance half-way between the two ends of said oblong ball, said plurality of ballast members dimensioned and arranged to weight said balloon to a near neutral state:

end ballast releasably attached to one of said ends of said oblong ball, said end ballast dimensioned and arranged to balance an inflation valve of the balloon thereby causing a static list-free attitude of said oblong ball; and wherein said balloon, said plurality of ballast members, and said end ballast are dimensioned and arranged such that when said balloon is thrown with a spinning motion, said balloon exhibits dynamic flight characteristics due primarily to its centrifugal properties at a desired attitude and altitude.

* * * * *